US005513756A

United States Patent [19]

McKillion et al.

[11] Patent Number: 5,513,756

[45] Date of Patent: May 7, 1996

[54] SCREENING APPARATUS HAVING A SCREEN TENSIONING DEVICE

[75] Inventors: Liam McKillion, Coalisland; Frank McMahon, Dungannon, both of Great Britain

[73] Assignee: Powerscreen International Distribution Limited, Dungannon, Northern Ireland

[21] Appl. No.: 284,428

[22] PCT Filed: Aug. 2, 1994

[86] PCT No.: PCT/GB93/00227

§ 371 Date: Aug. 24, 1994

§ 102(e) Date: Aug. 24, 1994

[87] PCT Pub. No.: WO93/14883

PCT Pub. Date: Aug. 5, 1993

[30] Foreign Application Priority Data

Feb. 3, 1992 [GB] Great Britain ..... 92 02 216

[51] Int. Cl.[6] ..... B07B 1/49

[52] U.S. Cl. ..... 209/404; 209/405; 209/412

[58] Field of Search ..... 209/319, 325, 209/347, 402, 403, 404, 405, 409, 412, 413, 421

[56] References Cited

U.S. PATENT DOCUMENTS

| | | | |
|---|---|---|---|
| 3,655,045 | 4/1972 | McAllister, Jr. | 209/405 X |
| 3,968,033 | 7/1976 | Illemann et al. | 209/403 |
| 4,319,992 | 3/1982 | Davis et al. | 209/319 X |
| 4,420,391 | 12/1983 | Sharki | 209/403 |
| 4,655,907 | 4/1987 | Ando | 209/404 |

FOREIGN PATENT DOCUMENTS

| | | | |
|---|---|---|---|
| 549969 | 1/1957 | Belgium . | |
| 238455 | 9/1987 | European Pat. Off. . | |
| 2501750 | 7/1975 | Germany . | |
| 2938684 | 4/1981 | Germany . | |
| 8902982 | 6/1989 | Germany . | |
| 343212 | 1/1960 | Switzerland | 209/404 |
| 1195748 | 6/1970 | United Kingdom | 209/404 |

*Primary Examiner*—William E. Terrell
*Assistant Examiner*—Tuan Nguyen
*Attorney, Agent, or Firm*—Edwin E. Greigg; Ronald E. Greigg

[57] ABSTRACT

A rectangular screen box is supported through a plurality of shock absorbing members from an elongate mounting frame. The screen box has an upstanding wall surround along three sides thereof and within which two vertically-spaced stations are provided. Each station is to carry an elongate screening surface having engaging elements at each longitudinal end thereof to be secured to a respective holding bar member arranged transversely between opposite sides of the surround and near opposite ends of each station. The outer ends of one bar member for each station extend out through an opening in opposite sides of the surround to be engagable by an element to move the bar member for each station relatively apart to longitudinally tension a screening surfaced secured thereto.

6 Claims, 2 Drawing Sheets

SCREENING APPARATUS HAVING A SCREEN TENSIONING DEVICE

BACKGROUND OF THE INVENTION

This invention relates to screening apparatus for use in size classifying discrete material. Heretofore, screening apparatus has been provided of the type having a screen box with an upstanding surround within which one or more vertically-spaced stations have been provided each to horizontally carry an elongate screening surface. The action of size classifying material passed into the screen box is effected by vibratory, reciprocatory, or oscillatory means. The or each screening surface has engaging means at longitudinally opposite ends each to be secured to a holding member arranged transversely, one at each longitudinally opposite ends of the station. Desirably, but not essentially, one holding member is fixed and the other holding member is movably adjustable to allow longitudinal tensioning or releasing of a respective screening surface. Replacing worn screening surfaces or changing screening surfaces to give a different grade(s) of material on existing screening apparatus of the above type is time consuming particularly, but not only, in the tensioning aspect of the replacement screening surfaces and this is disadvantageous.

SUMMARY OF THE INVENTION

An object of the present invention is to obviate or mitigate the above disadvantage.

Accordingly, the present invention is a screening apparatus comprising a substantially rectangular screen box supported through a plurality of shock absorbing members from an elongate mounting frame, the screen box having an upstanding wall surround around at least three sides thereof and within which one or more vertically-spaced stations are provided, the or each station being to carry an elongate screening surface having engaging means at each longitudinal end thereof, each engaging means to be secured to a respective holding bar member arranged transversely between opposite sides of the surround and at or near opposite ends of each station, the outer ends of one or both bar members for each station extending out through an opening in opposite sides of the surround to be engagable by means to move the bar members for each station relatively apart to longitudinally tension a screening surface secured thereto, the moving means for each outer end of the or each bar member being powered length-extension means carried in an out-of-use position on respective components of the frame laterally of each opposed side of the surround and each being transferable for mounting to an in-use position on the respective opposed side of the surround between an anchorage and the respective outer end of the bar member., and power means to actuate said moving means.

Preferably, the length-extension means are hydraulically or pneumatically operable ram and cylinder arrangements. The outer end of the cylinder of each arrangement is desirably provided with an apertured lug and the outer end of the ram of each arrangement is desirably provided with a cup.

Preferably also, fixing means are provided to secure each end of a bar when the respective arrangements are in their extended positions.

BRIEF DESCRIPTION OF THE DRAWINGS

An embodiment of the present invention will now be described, by way of example, with reference to the accompanying diagrammatic drawings, in which.

DETAILED DESCRIPTION OF THE DRAWINGS

Figure 1:
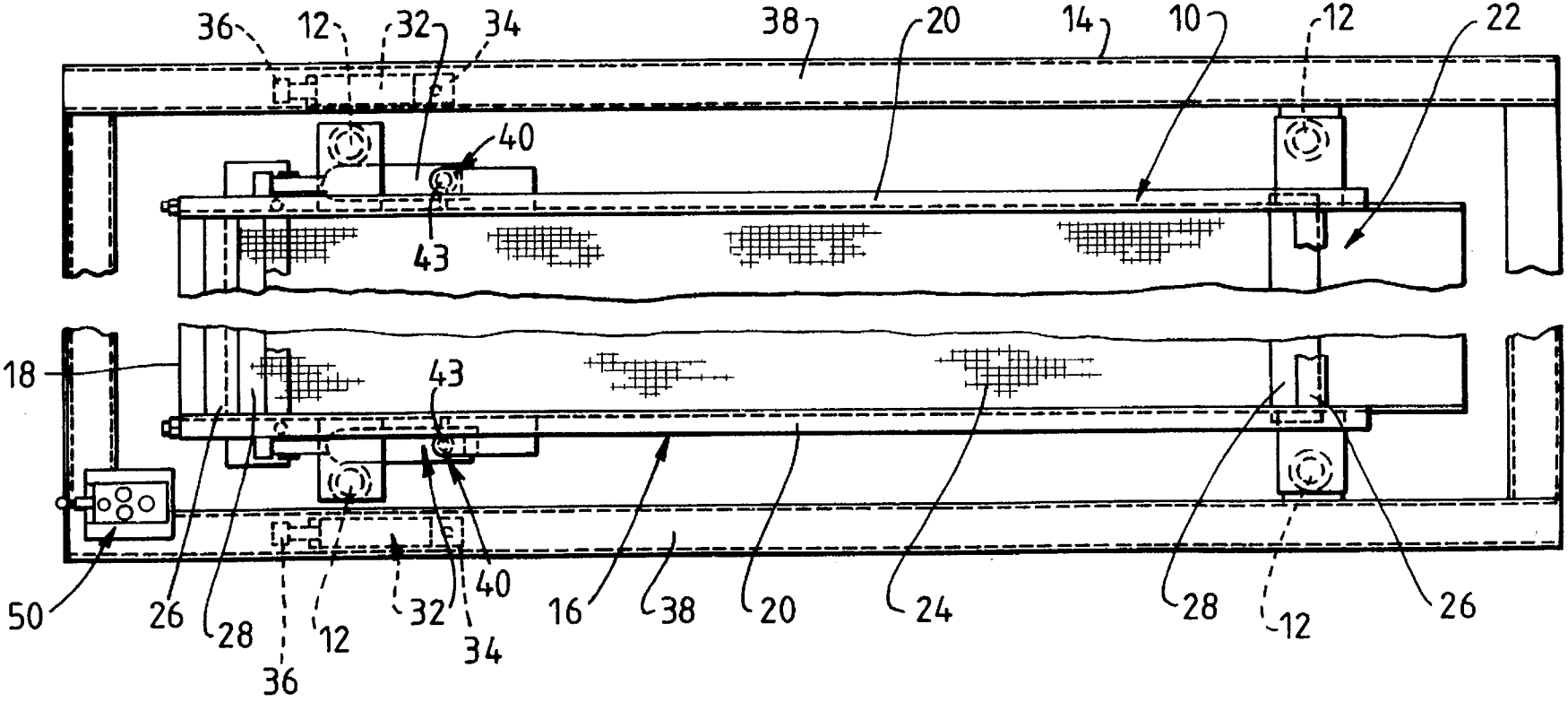
FIG. 1 is a plan view of a screening apparatus according to the present invention shown broken longitudinally to indicate various widths.
Figure 2:
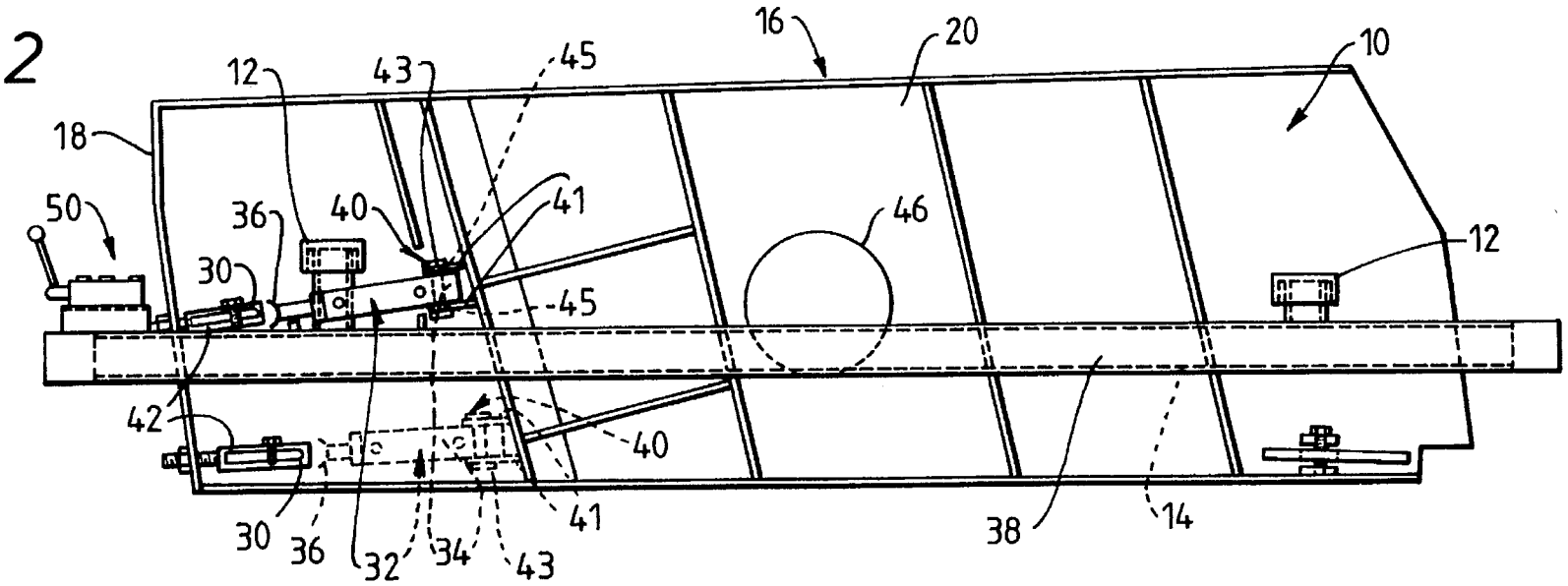
FIG. 2 is a side view.
Figure 3:
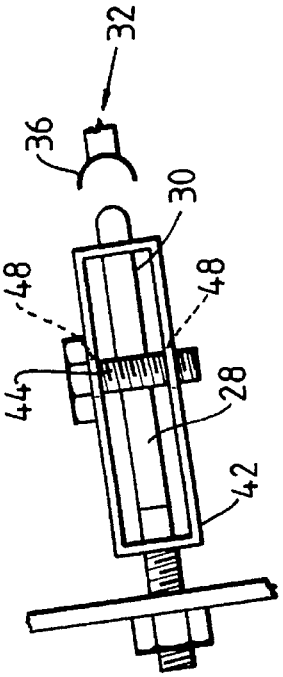
FIG. 3 is a side view of a detail of a fixing means.

Referring to the drawings, a screening apparatus comprises a rectangular screen box 10 supported through a plurality of shock absorbing members 12 from an elongate rectangular mounting frame 14.

The screen box 10 has an upstanding wall surround 16 around at least three sides thereof, ie. one end 18 and two opposed sides 20, and within the area defined by said sides one or more vertically-spaced stations 22 (two are shown in this embodiment) are provided.

Each station 22 is to carry an elongate screening surface 24 having engaging means at each longitudinal end thereof. Each screening surface masks the area defined by the three sides.

Each engaging means is in the form of a reflexive bent portion 26 which is to be secured to, ie. hooked over, a respective holding bar member 28 arranged transversely between opposite sides 20 of the surround 16 and at or near opposite ends of each station 22. The outer ends of one or both bar members 28 for each station 22 extend out through an opening 30 in opposite sides 20 of the surround 16. In this embodiment, only one bar member 28, ie. that nearer the end 18, is movable and extends through openings 30. The other bar member 28 is fixed to the sides 20. The outer ends of the movable bar member 28 for each station are each to be engagable by means to move the bar member 28 relatively apart from the fixed bar member 28 to longitudinally tension a Screening surface 24 secured thereto.

The moving means for each outer end of each movable bar member 28 is a powered length-extension means. The length-extension means are hydraulically or pneumatically operable ram and cylinder arrangements 32. The outer end of the cylinder of each arrangement 32 is provided with an apertured lug 34 and the outer end of the ram of each arrangement 32 is provided with a cup 36. The arrangements 32 are carried in an out-of-use position on respective longitudinal components 38 of the frame 14 laterally of each opposed side 20 of the surround 16. Each arrangement 32 is transferable for mounting to an in-use position on the respective opposed side 20 of the surround 16 between an anchorage 40 and the respective outer end of the movable bar member 28. Each anchorage 40 comprises two parallel cheeks 41 outstanding from the respective side 20, the cheeks being spaced apart vertically to receive the corresponding lug 34, there being an aligned hole 45 in the cheeks 41 positioned for the aperture in the lug 34 to be aligned therewith and a pin 43 insertable therein to secure the cheeks 41 and lug 34 together.

Power means to actuate said moving means is provided comprising a hydraulic fluid supply (not shown) and a hydraulic pump (not shown) connected up to the arrangements 32 by hosing (omitted for clarity) through a control valve mechanism 50. Alternatively, the power means is a pressurised air supply fed through hosing to the arrangements 32 with a control valve mechanism interposed in the hosing circuit.

Fixing means are provided to secure each outer end of a movable bar member 28 when the respective arrangements 32 are in their extended positions. The fixing means comprises a collar 42 outstanding from around each opening 30, the collars each having two straight portions, a top and a bottom, in which one or more aligned apertures 48 are provided to be engaged by a bolt or pin 44 on the inner side of the respective outer end of the movable bar member 28 when extended.

For use, the screening apparatus is mounted on a machine or structure via the frame 14 to receive discrete material. The action of size classifying material fed into the screen box 10 is achieved by vibratory, reciprocatory or oscillatory means shown generally at 46. The arrangements 32 are stored in their out-of-use position on components 38 so that they are not affected by movement of the screen box 10 due to the means 46. When a screening surface requires to be replaced or when a different grade of material is required necessitating a change of screening surface, the arrangements 32 for each station are moved into their in-use position and each is secured by the respective pin 43 passing through the corresponding aligned apertures in lug 34 and cheeks 41, and with the cup 36 positioned to engage the respective outer end of movable bar member 28. The rams of the arrangements 32 are extended for the cups 36 to engage their respective outer end of movable bar member 28. The respective pins 44 are removed and the rams retracted. The screening surface 24 is removed and the new screening surface located over the bar members 28. The rams are again extended and the pins 44 located. The rams are then retracted, the pins 43 removed and the arrangements 32 moved to their respective out-of-use positions.

Variations and modifications can be made without departing from the scope of the invention described above and as claimed hereinafter.

We claim:

1. A screening apparatus comprising:

an elongate mounting frame;

a rectangular screen box supported through a plurality of shock absorbing members from said frame, the screen box having an upstanding wall surround along at least three sides thereof;

one or more vertically-spaced stations provided in said surround;

an elongate screening surface to be carried by the or each station, said screening surface having engaging means at each longitudinal end thereof, each engaging means to be secured to a respective holding bar member arranged transversely between opposite sides of the surround and at or near opposite ends of each station, the outer ends of one or both bar members for each station extending out through an opening in opposite sides of the surround to be engagable by means to move the bar members for each station relatively apart to longitudinally tension a screening surface secured thereto;

the moving means for each, outer end of the or each bar member being powered length-extension means carried in an out-of-use position on respective components of the frame laterally of each opposed side of the surround and each being transferable for mounting to an in-use position on the respective opposed side of the surround between an anchorage and the respective outer end of the bar member; and power means to actuate said moving means.

2. A screening apparatus according to claim 1 wherein the length-extension means are hydraulically or pneumatically operable ram and cylinder arrangements.

3. A screening apparatus according to claim 2, wherein the outer end of the cylinder of each arrangement is provided with an apertured lug and the outer end of the ram of each arrangement is provided with a cup.

4. A screening apparatus according to claim 2, wherein fixing means are provided to secure each end of a bar when the respective arrangements are in their extended positions.

5. A screening apparatus according to claim 3, wherein fixing means are provided to secure each end of a bar when the respective arrangements are in their extended positions.

6. A screening apparatus according to claim 4, wherein the fixing means comprises a collar outstanding from around each opening, the collars each having two vertically spaced portions in which one or more aligned apertures are provided to be engaged by a bolt when a respective outer end of the movable bar member has been extended therebeyond.

* * * * *

UNITED STATES PATENT AND TRADEMARK OFFICE

CERTIFICATE OF CORRECTION

PATENT NO. : 5,513,756

DATED : May 7, 1996

INVENTOR(S) : Liam McKillion et al

It is certified that error appears in the above-identified patent and that said Letters Patent is hereby corrected as shown below:

On the title page, item [22] should read as follows:

[22] PCT Filed: Feb. 3, 1993

Signed and Sealed this

Twenty-sixth Day of November 1996

*Attest:*

Bruce Lehman

BRUCE LEHMAN

*Attesting Officer*

*Commissioner of Patents and Trademarks*